United States Patent [19]

Murry et al.

[11] Patent Number: 4,835,979

[45] Date of Patent: Jun. 6, 1989

[54] SURGE CONTROL SYSTEM FOR A CLOSED CYCLE CRYOCOOLER

[75] Inventors: Roger P. Murry, San Pedro; Alexander Silver, Tarzana; Richard L. Fischer, Rolling Hills Estates, all of Calif.

[73] Assignee: Allied-Signal Inc., Morris Township, Morris County, N.J.

[21] Appl. No.: 136,162

[22] Filed: Dec. 18, 1987

[51] Int. Cl.[4] ..... F25B 9/00

[52] U.S. Cl. ..... 62/172; 62/87; 62/402

[58] Field of Search ..... 62/172, 401, 196.3, 62/510, 113, 513, 87, 402, 117, 504, 208, 209, 210

[56] References Cited

U.S. PATENT DOCUMENTS

| | | | |
|---|---|---|---|
| 2,293,557 | 8/1942 | Newton | 62/6 |
| 2,697,917 | 12/1954 | Mayer | 62/2 |
| 3,080,728 | 3/1963 | Groves et al. | 62/172 |
| 3,095,710 | 5/1960 | Clark | 62/117 |
| 3,133,425 | 5/1964 | Hanny et al. | 62/172 |
| 3,199,304 | 8/1965 | Zeitz et al. | 62/403 X |
| 3,200,613 | 8/1965 | Zotos | 62/402 |
| 3,214,938 | 11/1965 | Zotos | 62/402 |
| 3,321,930 | 5/1967 | La Fleur | 62/228 |
| 3,555,844 | 1/1971 | Fleckenstein et al. | 62/217 |
| 3,613,387 | 10/1971 | Collins | 62/513 X |
| 4,103,506 | 8/1978 | Adalbert et al. | 62/61 |
| 4,151,725 | 5/1979 | Kountz et al. | 62/182 |
| 4,161,107 | 7/1979 | Korsakov-Bogatov et al. | 62/117 |
| 4,267,701 | 5/1981 | Toscano | 62/402 X |
| 4,444,019 | 4/1984 | Arkharon et al. | 62/87 |
| 4,566,291 | 1/1986 | Halavais | 62/402 |

FOREIGN PATENT DOCUMENTS

| | | |
|---|---|---|
| 331415 | 8/1958 | Switzerland . |
| 802744 | 2/1981 | U.S.S.R. . |
| 1017887 | 5/1983 | U.S.S.R. . |
| 790355 | 2/1958 | United Kingdom . |

*Primary Examiner*—Harry B. Tanner

*Attorney, Agent, or Firm*—J. Henry Muetterties; Robert C. Smith

[57] ABSTRACT

A cryocooler system including a reversed Brayton cycle turbo-refrigerator system having a surge control valve in the bypass line between the compression section inlet and outlet. The compression section includes at least one compressor and an aftercooler which rejects the heat of compression to a heat sink. The cooling section includes at least one regenerator and a turbo-alternator for expansive cooling of the working fluid.

12 Claims, 4 Drawing Sheets

SURGE CONTROL SYSTEM FOR A CLOSED CYCLE CRYOCOOLER

This invention was made with Government support under Contract No. F29601-85-C-0108 awarded by the United States Air Force. The Government has certain rights in this invention.

BACKGROUND OF THE INVENTION

This invention relates to cryocoolers and more particularly to a cryocooler system utilizing a closed, reverse Brayton Cycle cryogenic refrigerator.

Turbo-refrigerator systems provide cryogenic cooling over a wide range of temperatures. Several cooling loads at different temperatures can be readily served. A single-expander system is usually satisfactory for refrigeration temperatures as low as 80° K. When the need arises for lower cooling temperatures, multi-expander systems provide greater cycle efficiency. Multi-expander systems also allow for integration of additional cooling loads into the refrigeration flow circuit.

A closed cycle turbine system is stable only when operating within specific design limits. The system operating off-design is inherently unstable and susceptible to surge, which if not properly controlled and damped out quickly, results in damage to the rotating machinery and catastrophic failure of the system. Therefore, for a closed cycle turbine system a control is necessary to prevent surge.

SUMMARY OF THE INVENTION

It is an object of the present invention to provide a surge control for a reversed Brayton turbo-refrigerator.

It is another object of the present invention to provide a surge control for a cryogenic cooling system having three-expanders, wherein all three-expanders are mounted on a single shaft.

It is still a further object of the present invention to provide a surge control located between the compression section and the cooling section of a closed cycle, cryogenic refrigerator.

The present invention is a cryocooler system comprising a reversed Brayton Cycle turbo-refrigerator having a surge control valve and a triple turbo-alternator. The system comprises two motors each driving a pair of compressors on a common shaft. An aftercooler is located downstream of each of the four compressors, which rejects the heat of compression to a heat sink. The system further includes five recuperators which provide heat exchange between the high-and low-pressure gas streams. The three turbines of the turbo-alternator provide expansion cooling of the working fluid at approximate temperature levels of the three cooling loads. The primary load is handled by the third cooling stage (third turbine exhaust), while the warmer two secondary loads correspond to the first and second turbines. All three turbines are mounted on a common shaft and power an alternator.

Working fluid exiting the fourth aftercooler enters the high pressure side of the series of five recuperators. Fluid is bled off the outlet of the first recuperator in order to drive the first turbine. The exhaust of the first turbine is flow connected to the low pressure side of the inlet to the second recuperator. Fluid is also bled off the outlet of the third recuperator in order to drive the second turbine; the exhaust of which is fed into the inlet of the low pressure side of the fourth recuperator. The primary load is downstream of the third turbine. The secondary loads are located downstream of the fourth and second recuperators. A bypass line is located between the inlet of the high and the outlet of the low pressure sides of the first recuperator. The surge control valve is located in the bypass line to prevent compressor surge.

DETAILED DESCRIPTION OF THE INVENTION

Figure 1:
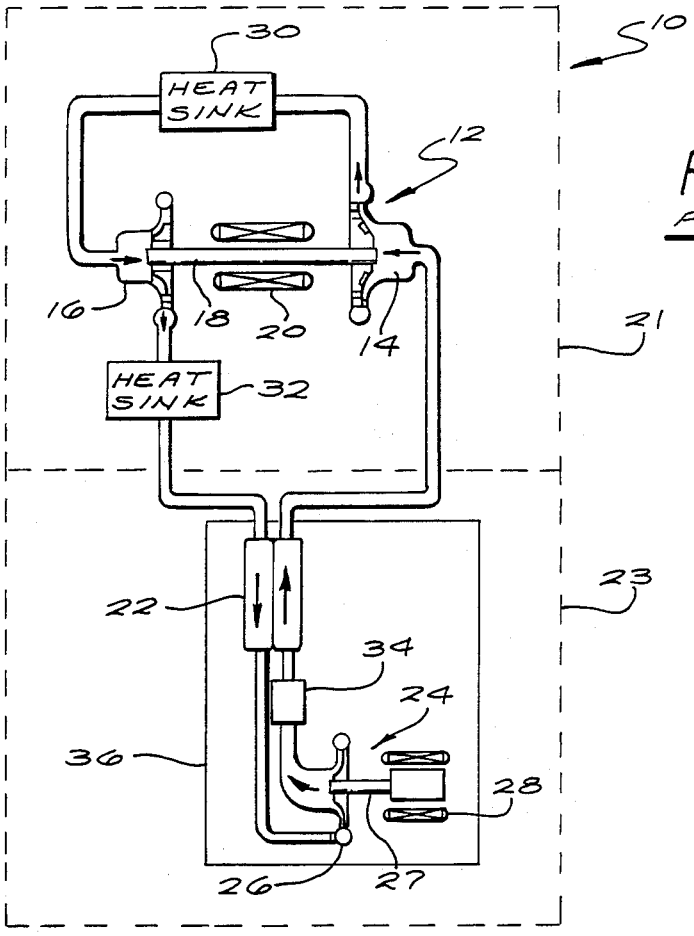
FIG. 1 PRIOR ART
FIG. 1 is a schematic diagram of a known single-stage turbo-refrigerator system without a surge control valve.

Shown in FIG. 1 is a single-stage turbo-refrigerator system 10 comprising a two stage motor-driven compressor 12, having a first and a second compressor 14 and 16, respectively mounted on a common shaft 18 which is driven by a motor 20, a recuperator 22 and a turbo-alternator 24 including an expansion turbine 26 and an alternator 28.

The system is a closed system, reversed Brayton cycle having a compression section 21 and a cooling section 23 wherein the working fluid is compressed at ambient temperature in the first compressor 14 and thereafter the heat of compression is removed in a first heat sink or aftercooler 30 before being further compressed in the second compressor 16. The working fluid is thereagain passed through a second heat sink or aftercooler 32 to reduce the temperature increase of the compression stage. The high pressure fluid is then cooled in a recuperative heat exchanger (recuperator) 22 by the low pressure fluid returning to the first compressor 14 from the expansion turbine 26. Fluid exiting the recuperator 22 is expanded in the turbine 26 thereby extracting energy from the fluid to drive the shaft 27 and providing electrical output at the alternator 28. The output of alternator 28 can be used to reduce the motor 20 power input by a small amount. When this energy is removed from the fluid of the cold region of the system, the resulting temperature decrease during the work-producing expansion supercools the fluid downstream of the turbine 26 allowing the fluid to absorb energy at supercooled temperature. The supercooled fluid provides useful refrigeration to a cooling load 34 downstream of expansion turbine 26. The fluid returns to the first compressor 14 through the low pressure side of the recuperator 22. Once in operation, the rotating elements of the compressor and the turbine are supported on gas bearings incorporating a film of the gaseous working fluid. With gas bearings, wear-producing surface friction is present only at startup and shutdown. The recuperator 22 and the turbo-alternator 24 are isolated from the environment in an insulated enclosure 36.

Figure 2:
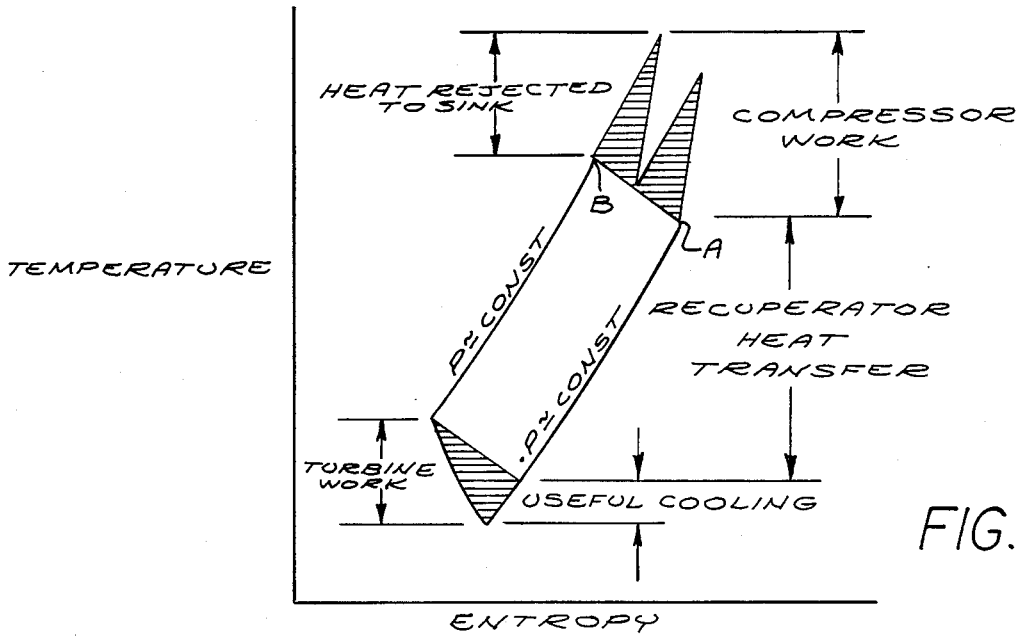
FIG. 2 is a graph of the temperature vs entropy of the working fluid in the system of FIG. 1.

FIG. 2 is a temperature vs entropy map of the single-stage turbo-refrigerator system of FIG. 1 wherein point A represents the temperature and entropy of the working fluid entering compressor 14 and point B represents the temperature and entropy at the outlet of heat sink or aftercooler 32.

Figure 3:
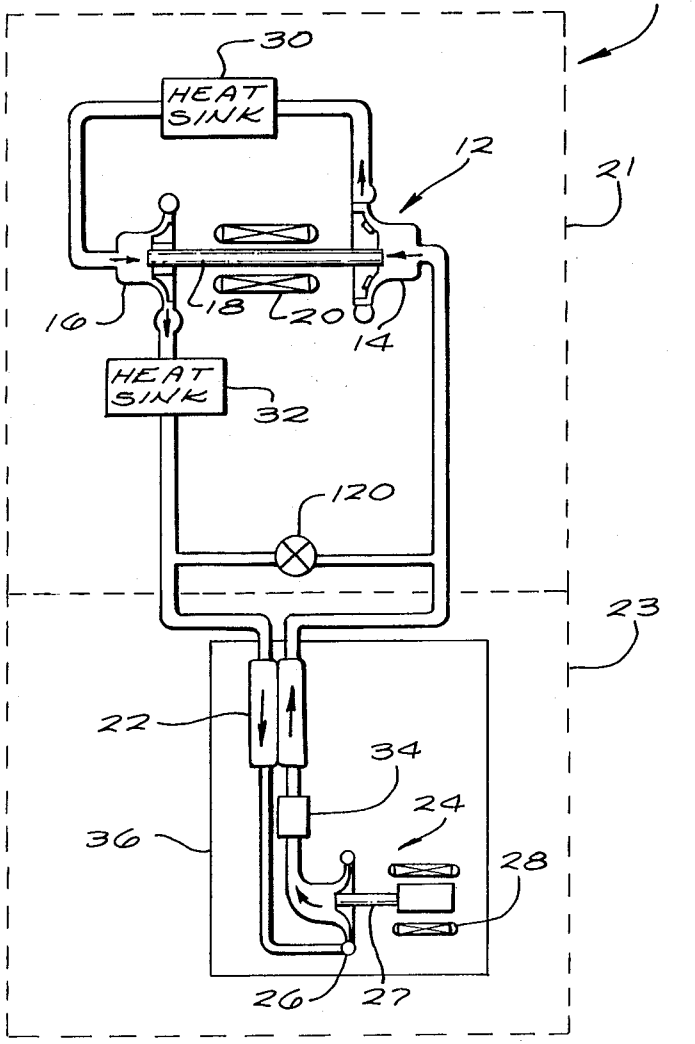
FIG. 3 is a schematic diagram of the single-stage turbo-refrigerator system of FIG. 1 and including the surge control valve of the present invention.

FIG. 3 is a schematic diagram of the single-stage turbo-refrigerator system of FIG. 1 with a surge control valve 120 located in a bypass line 121 between the inlet and outlet of the compression section 21. When open, valve 120 and bypass line 121 allows fluid to pass from the outlet of aftercooler 32 directly into compressor 14.

Figure 4:
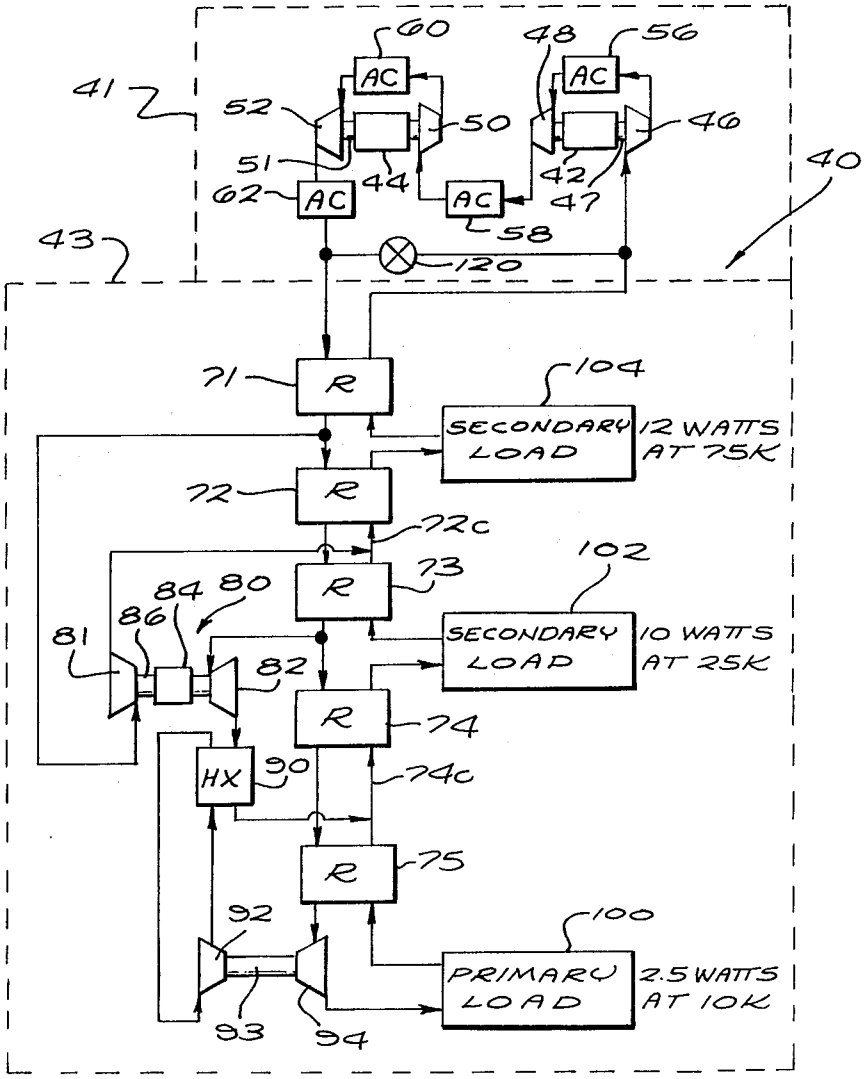
FIG. 4 is a schematic diagram of a three-stage turbo-refrigerator system with a surge control valve of the present invention.

FIG. 4 is a schematic diagram of a three-expander, reversed Brayton turbo-refrigerator system 40 including the surge control valve. The system as shown is characterized by a compression section 41 and a cooling section 43. The compression section 41 includes four stages of compression followed by four stages of aftercooling, while the cooling section 43 includes three steps of expansion and five stages of counterflow heat exchange between the high and low pressure gas streams.

Compression of the working fluid is accomplished by utilizing two motors 42, 44 each driving a pair of compressors; 46 and 48; 50 and 52 respectively, on a common shaft 47 and 51 respectively. Immediately downstream of each compressor is an aftercooler (56, 58, 60 and 62) which transfers the heat of compression to a heat-transport loop which interfaces with a space radiator (not shown in FIG. 3, see FIG. 4). Working fluid exiting the aftercooler 62 has a pressure ratio of Pout (62)/Pin (47)=2/1.

The working fluid exiting the aftercooler 62 is passed through a first recuperator 71 wherein the high pressure fluid is cooled. Upon exiting the first recuperator 71, the fluid flow is divided between a second recuperator 72 and a dual turbo-alternator 80. Turbo-alternator 80 comprises a first and a second turbine, 81 and 82, mounted on a common shaft 86 and an alternator 84 therebetween. The fluid enters the first turbine 81 wherein it is expanded before returning to the inlet of the low pressure side 72*c* of the second recuperator 72. During the expansion step, the fluid imparts a portion of its energy into turning the shaft 86.

The fluid exiting the first recuperator 71 is further cooled in the second and a third recuperator 72, 73. Fluid flow exiting the third recuperator 73 is again split into two flow paths; one path to the second turbine 82 of turbo-alternator 80 and the second path goes to the fourth and fifth recuperators 74 and 75 wherein it is further cooled.

Fluid flow exiting the second turbine 82 has been expanded and in a run through a heat exchanger 90 which is heat exchange relationship with a closed loop of a second working fluid which may or may not be the same as the first working fluid. The closed loop includes a fan 92 in addition to heat exchanger 90. The expanded and heated first working fluid exiting the heat exchanger 90 is flow connected to the inlet of the low pressure side 74*c* of the fourth recuperator 74.

The fluid exiting the high pressure side of the fifth recuperator 75 is passed through a third turbine 94 which is mounted on a common shaft 93 with fan 92. Fan 92 and heat exchanger 90 serve as a heat sink for turbine 94. Turbine 94 further cools the fluid by expansion therethrough. The cooling design point of the system is reached at this stage in that the requisite cooling is now available to a primary load 100.

On the heat sink or low pressure side of the return line the fluid is used to cool the primary load 100 before being heated in the fifth and fourth recuperators 75 and 74 respectively. It is thereafter fed into a low temperature, secondary load 102 before being heated in the third and second recuperators, 73 and 72. Finally, the fluid is fed to a high temperature, secondary load 104 and further heated in the first recuperator 71 before returning to the four stages of compression.

Figure 5:
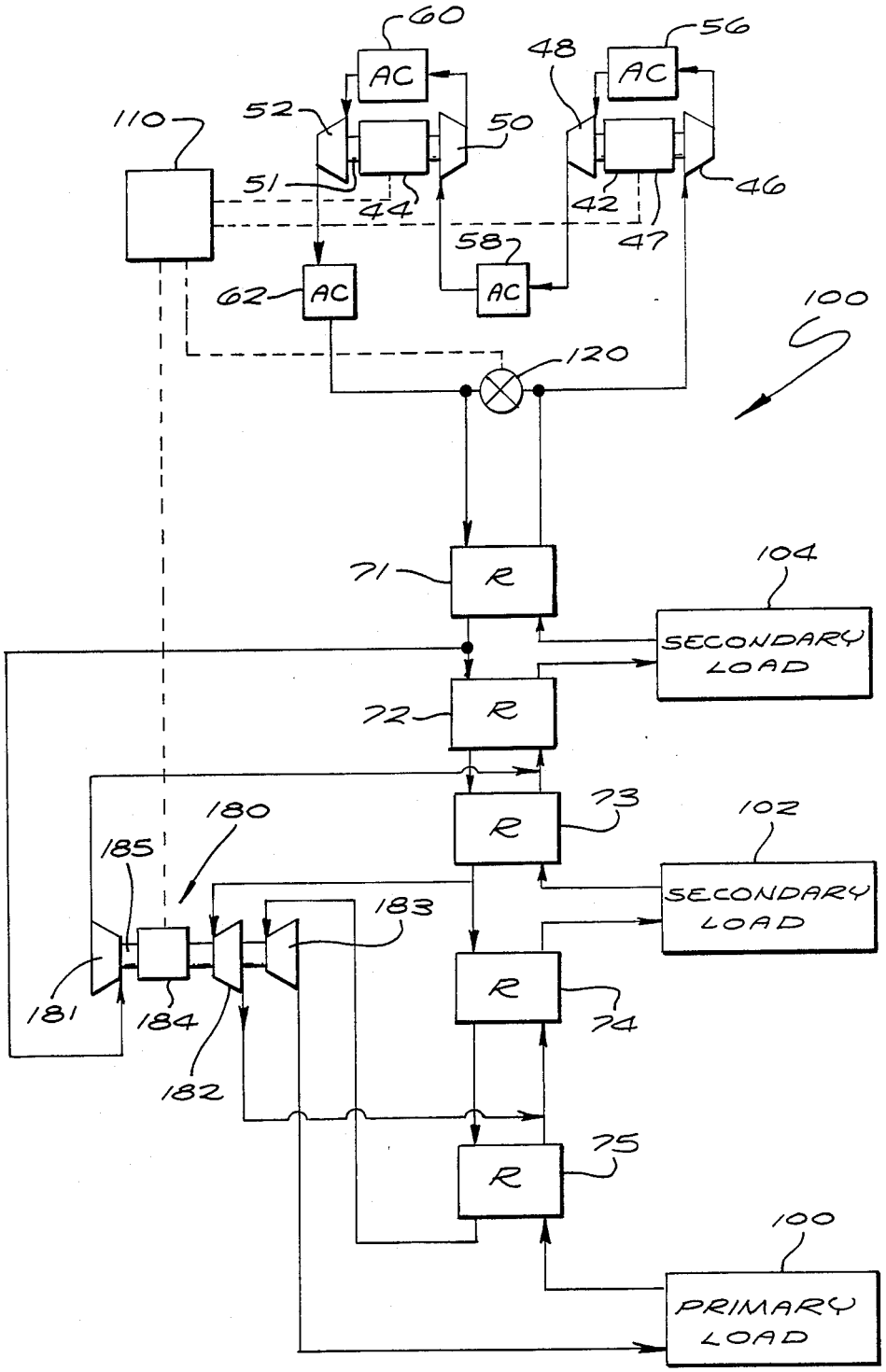
FIG. 5 is a schematic diagram of an alternative cryocooler system featuring a triple turbo-alternator and a surge control valve of the present invention.

FIG. 5 shows a schematic diagram of the present invention which differs from the system as shown in FIG. 4 in that it includes a triple turbo-alternator or triple turbo-expander 180. For clarity, like elements have been given the same reference numerals in FIGS. 4 and 5.

As shown in FIG. 5, the turbo-alternator 180 includes the three turbines 181, 182 and 183 on a common shaft 185. The fluid exiting the high pressure side of the fifth recuperator 75 is fed to the third turbine 183 which is also mounted together with the first and second turbine on shaft 185 to power the alternator 184. This design allows for a small increase in the amount of energy removed from the fluid in the system, therefore allowing for a lower temperature design point.

Also included in the preferred embodiment is an electronic controller 110 which senses the speeds of the two motors 42 and 44 as well as the turbo-alternator 184 and in turn controls the position of the surge control valve 120. Surge control valve 120 has only open and closed positions; this valve is sold by Moog Inc. of New York.

The cryocooler system of FIG. 5 is designed to be utilized in a space application. As such, the system is designed to have a 2:1 pressure increase through the compression section 41 so that Pout (62):Pin (47)=2:1 and that the Tout (62)=Tin (47).

The system is initially charged with helium to 120 psig. The motors 42, 44, 84 (184), are turned off, and the loads 100, 102, 104 are shut down. Once the system is in place, the constant torque motors 42 and 44 are powered. The bypass valve 120 is in the open position.

Figure 6:
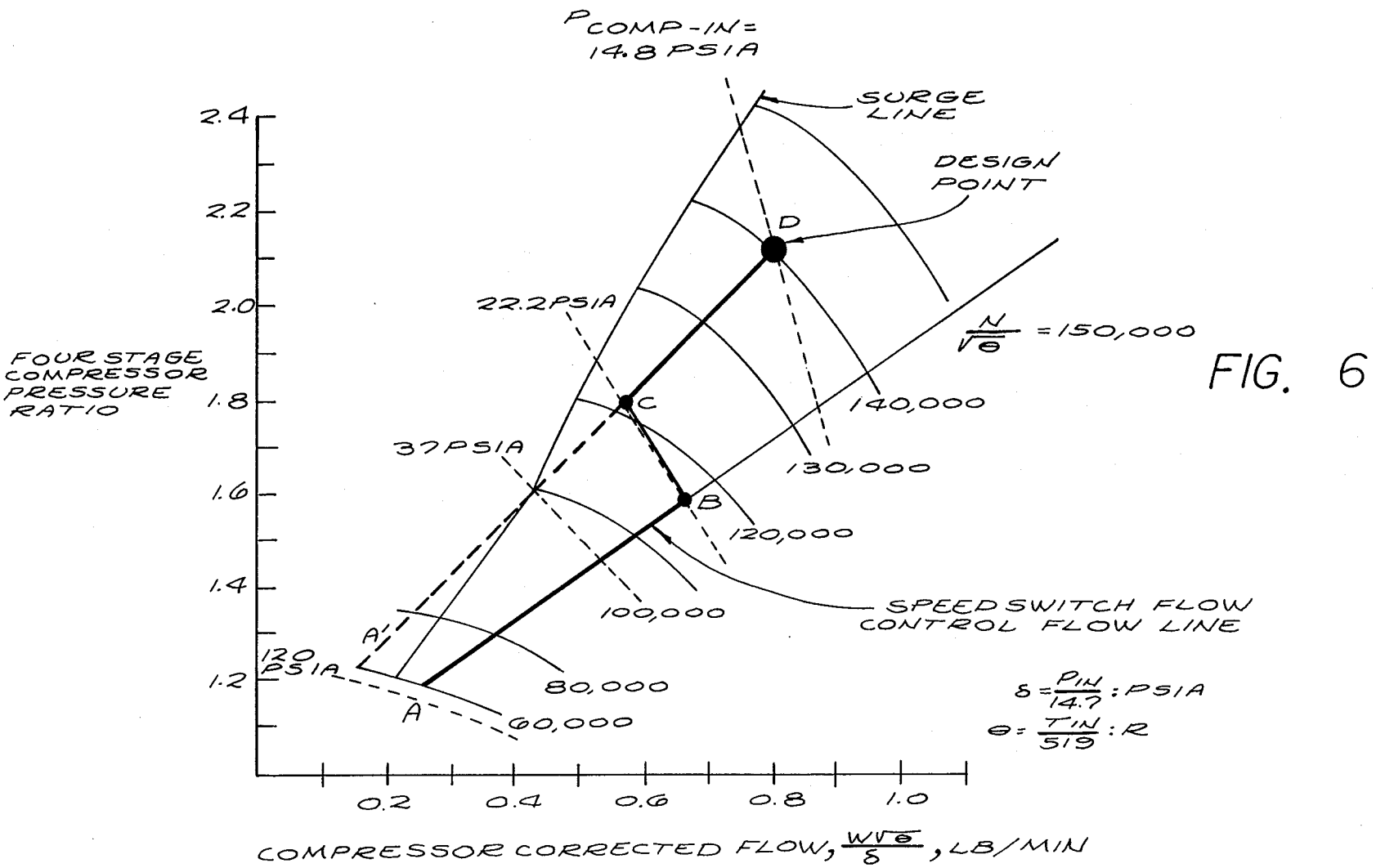
FIG. 6 is a graph of a particular compressor surge control schedule for the cryocooler system shown in FIGS. 3 or 4.

FIG. 6 shows how the system of FIG. 5 reacts, going from its charged, inactivated condition to steady state condition. As shown in FIG. 6, the dotted lines represent lines of constant pressure while the solid lines represent lines of constant compressor speed.

Once the constant torque motors 42 and 44 are turned on the working fluid exiting aftercooler 62 is either recirculated into the compression section 41 or flows into the cooling section 43. In this manner the fluid exiting the fifth recuperator 75 begins to get colder and the pressure of the fluid entering the compressor section 41 decreases due to the expansion through each of the three turbines; see line A-B in FIG. 6. The speed of the constant torque compressor increases with decreasing inlet pressure. At a predetermined compressor speed, the bypass valve 120 is closed (Point B). All fluid flow thereafter exiting the aftercooler 62 enters the high pressure side of the cooling section 43. This causes an increase in compressor speed and a decrease in the compressor flow rate; see line B-C. Thereafter, the system continues to cool down with a corresponding increase in compressor speed and compressor flow rate until the design point D is reached, at which time the loads 100, 102 and 104 are switched on.

At steady state operation, the compressor section 41 provides a 2:1 pressure increase with no corresponding temperature increase. The turbines are designed so that the inlet pressure is approximately 30 psia and the outlet pressure is approximately 15 psia. In order to control the fluid flow rates through the compression section 41, the total area of the orifices in the three turbines 181, 182, and 183 must be designed to give the desired volumetric flow into compressor 46. Furthermore, since the second and the fourth recuperators 72 and 74 have much greater flow rates on the low-pressure side than on the high-pressure side, the recuperators are smaller than the other three recuperators which have nearly balanced flow rates on the low- and high-pressure sides. The alternator 184 converts the turbine shaft output to electrical power thereby conserving energy from the system. Thus the turbo-alternator output can be used to reduce the input power to the motors by 4 to 5 percent.

FIG. 6 is a graph of the four stage ratio vs compressor corrected flow of the system in FIG. 5. The surge line sets forth the limit between stable flow conditions to the right of the surge line versus unstable flow conditions to the left of the line.

Starting with the desired design point D, which is necessary in order to obtain the required cooling temperatures for each of the three loads at steady state conditions, the system must be able to operate in the stable flow region. Hence, without the surge control valve, the starting point would need to be point A; however, operation of the system would be at A' in the unstable region.

Utilization of the surge control valve gives the system the flexibility to operate completely in the stable region. The system operating conditions follow line A-B before the valve is closed. Once closed the system experiences an increase in compressor speed and compression ratio with a slight decrease in the compressor flow rate, line B-C.

Point C has been chosen since it represents an approximate 15 percent surge control margin; ie. the compressor flow rate is approximately 15% greater than the compressor flow rate of the surge line. In addition, point B could be moved further up line ABF. However, delaying the closing of the surge control valve prolongs operating the system at a reduced alternator power. It is important to take energy out of the system via alternator 184 in order to accelerate the reduction in temperature at recuperator 75.

Various modifications to the desired and described apparatus and method will be apparent to those skilled in the art. Accordingly, the foregoing detailed description of the invention should be considered exemplary in nature, and not as limiting to the scope and spirit of the invention as set forth in the appended claims.

I claim:

1. A closed Brayton cycle, cryogenic refrigeration system for cooling at least one load comprising:

a compressor section having an inlet and outlet, including a first compressor and a second compressor mounted on a common shaft and driven by a first motor;

a third compressor and a fourth compressor mounted on a common shaft and driven by a seocnd motor; and an aftercooler located downstream of each compressor, a cooling section, having an inlet and an outlet for high and low pressure sides, including a plurality of recuperators in parallel relationship, each having an inlet and an outlet for high and low pressure sides and at least one expansion turbine; said inlet to said cooling section flow connected to the outlet of the compressor section and said cooling section outlet flow connected to the inlet of said compressor section; and including means for generating electrical power, said means powered by the working fluid bled off the high pressure side of said plurality of recuperators, and means for controlling surge in said compressor section including a bypass passage between said compressor section inlet and outlet;

a surge control valve in said bypass passage; and means responsive to a variable condition in said compressor section for opening and closing said valve.

2. The cryogenic refrigeration system of claim 1 wherein each aftercooler is cooled by the same heat sink.

3. The system of claim 1 wherein the cooling section comprises:

a first, second, third, fourth and fifth recuperator mounted in parallel relationship;

a first and a second turbine having an inlet and an outlet mounted on a common shaft;

an alternator mounted about said common shaft;

bleed lines from the outlet of said high pressure side of said cooling section to direct said working fluid to said first and second turbines;

return lines from said outlets of said turbines to said low pressure side of said cooling section;

a heat exchanger in said return line from said second turbine; and fan means, driven by a third turbine, for circulating a cooling medium through a heat exchanger, said third turbine being powered by the high pressure working fluid.

4. The system of claim 1 wherein the cooling section comprises:

a plurality of recuperators mounted in parallel relationship;

first, second and third turbines mounted on a common shaft, each turbine having an inlet and outlet;

an alternator mounted about said common shaft;

bleed lines from the high pressure side of said cooling section to direct said working fluid to said first, second and third turbines;

return lines from said outlets of said turbines to said low pressure side of said cooling section.

5. The cryogenic refrigeration system of claim 1 wherein said cooling section comprises:

a first, second, third, fourth and fifth recuperators mounted in parallel relationship, each having a low and high pressure side, each side having an inlet and outlet;

a turbo-alternator including a first, second and third turbine, each turbine mounted on a common shaft and an alternator mounted about said shaft;

bleed means for conducting high pressure working fluid to each of said three turbines; and means for returning said bleed working fluid to said low pressure side of the cooling section.

6. The system of claim 5 wherein said bleed means comprises:

a first conduit flow connecting the outlet of the high pressure side of said first recuperator and the first turbine;

a second conduit flow connecting the outlet of the high pressure side of the third recuperator and the second turbine; and a third conduit flow connecting the outlet of the high pressure side of the fifth recuperator to the third turbine.

7. The system of claim 6 wherein there are three loads on the system each connected in series with the low pressured sides of said first, third and fifth recuperators.

8. The system of claim 7 wherein the first load is flow connected between the outlet of said third turbine and the inlet to the low pressure side of said fifth recuperator and the second load is between the fourth and third recuperator and the third load is between the second and first recuperators.

9. A closed Brayton cycle, cryogenic refrigeration system for cooling at least one load comprising:

a compressor section, having an inlet and an outlet, including at least one motor driven compressor for compressing and means for cooling a working fluid;

a cooling section, having an inlet and an outlet and a high and low pressure side, said inlet to the high pressure side flow connected to the outlet of the compressor section and the outlet to the low pressure side flow connected to the inlet of the compressor section, including a plurality of recuperators in a parallel relationship and a turbo-alternator means for generating power within said system; and means for controlling surge in said at least one motor-driven compressor including a bypass passage between said compressor section inlet and outlet;

a surge control valve in said bypass passage; and means responsive to rotational speed of said motor-driven compressor for opening and closing said valve.

10. The system of claim 9 wherein said means for cooling comprises an aftercooler downstream of said at least one compressor.

11. The system of claim 9 wherein said compressor section comprises:

a first and second compressor mounted on a common shaft and driven by a first constant torque motor;

a third and fourth compressor mounted on a common shaft and driven by a second constant torque motor;

an aftercooler immediately downstream of each compressor.

12. The system of claim 9 wherein said means for opening and closing said valve includes an electronic controller and speed sensors for sensing the speeds of the motors and the turbo-alternator.

* * * * *